US006179381B1

(12) United States Patent
Gevaert

(10) Patent No.: US 6,179,381 B1
(45) Date of Patent: Jan. 30, 2001

(54) STATIONARILY-MOUNTED SEATING STRUCTURE HAVING ELECTRICAL AND DATA OUTLETS

(75) Inventor: Steven C. Gevaert, Green Bay, WI (US)

(73) Assignee: Krueger International, Inc., Green Bay, WI (US)

( * ) Notice: Under 35 U.S.C. 154(b), the term of this patent shall be extended for 0 days.

(21) Appl. No.: 09/229,921

(22) Filed: Jan. 13, 1999

Related U.S. Application Data

(60) Provisional application No. 60/071,513, filed on Jan. 15, 1998.

(51) Int. Cl.[7] ..... A47C 31/00

(52) U.S. Cl. ..... 297/217.3; 297/217.7; 52/8

(58) Field of Search ..... 297/217.3, 217.7; 52/8, 9, 10, 220.1; 174/53; 312/223.6; 308/50.02

(56) References Cited

U.S. PATENT DOCUMENTS

| | | | |
|---|---|---|---|
| 3,553,675 | 1/1971 | Shaver et al. . | |
| 4,509,097 | 4/1985 | Robinson . | |
| 4,880,270 | 11/1989 | Cooper . | |
| 4,925,240 | 5/1990 | Peters . | |
| 5,122,786 | 6/1992 | Rader . | |
| 5,271,590 | 12/1993 | Rosen . | |
| 5,318,340 | 6/1994 | Henry . | |
| 5,490,711 | 2/1996 | Pollock . | |
| 5,529,265 | 6/1996 | Sakurai . | |
| 5,542,589 | 8/1996 | McKee . | |
| 5,605,406 | 2/1997 | Bowen . | |
| 5,612,718 | 3/1997 | Bryan . | |
| 5,700,052 * | 12/1997 | Yamazaki et al. | 297/217.3 |
| 5,795,018 * | 8/1998 | Schumacher et al. | 297/217.3 |
| 5,807,177 * | 9/1998 | Schumacher et al. | 297/217.3 |
| 5,915,783 * | 6/1999 | McDowell et al. | 297/180.12 |
| 5,984,415 * | 11/1999 | Schumacher et al. | 297/217.3 X |

* cited by examiner

*Primary Examiner*—Anthony D. Barfield
(74) *Attorney, Agent, or Firm*—Andrus, Sceales, Starke & Sawall, LLP

(57) ABSTRACT

A seating structure including a series of seat assemblies each consisting of a pair of spaced side supports, a seat pivotably mounted between the side supports, a back fixed to the side supports, an electrical outlet positioned on one of the side supports, and at least one data outlet positioned on one of the side supports. Each of the side supports includes an outlet housing affixed to the lower surface of an arm rest contained on the side support. The outlet housing extends inwardly toward the seat surface and provides the seat occupant with an electrical outlet and at least one data outlet. The electrical wiring and data line for each seat assembly pass through a wireway contained in the seat back. A branch electrical power conduit passes through the side support and into the seat back where is it connected to the supply of electrical power. Likewise, a data line extends from the wireway contained in the seat back into the side support where it is connected to the data outlet. The wireway is used to supply power to each of the seat assemblies positioned in the continuous row of seating. In this manner, a single power connection through one of the side supports allows power to be supplied to a continuous row of seats.

29 Claims, 6 Drawing Sheets

STATIONARILY-MOUNTED SEATING STRUCTURE HAVING ELECTRICAL AND DATA OUTLETS

CROSS REFERENCE TO RELATED APPLICATION

This application is based on and claims priority from provisional patent application Ser. No. 60/071,513 filed on Jan. 15, 1998.

BACKGROUND AND SUMMARY OF THE INVENTION

The invention relates broadly to a stationarily-mounted seating structure, such as is used in row formation in an auditorium, theater, or the like. More specifically, the present invention pertains to a seating structure having a plurality of individual seat assemblies aligned in a row that each include an electrical outlet and at least one data outlet in one of the side supports for each seat assembly.

Stationarily-mounted seating structures are typically mounted to the floor of an auditorium, theater or the like, and generally include an aligned row of individual seats that each have a pair of side supports, with a seat and a seat back disposed between and mounted to the side supports. This type of seating structure is often used in large auditoriums in which educational classes or other lectures are given. For example, such seating structures are often found in university auditoriums or lecture halls.

In recent years, laptop computers have become increasingly popular and are used by a large number of people on a daily basis. At some universities, for example, each student is required to have a laptop computer which is used by the student during interactive multimedia classes. During such classes, the student's laptop computer is plugged into a computer network and each student participates in the lecture and accesses data over the university's computer network. In this type of classroom or lecture hall, a row of students sit behind a work surface in the form of a continuous desktop on seating which may or may not be interconnected with the supporting structure of the desktop. The desktop includes a plurality of spaced data outlets into which the students can connect their laptop computers. While in class, students operate their laptop computers off the internal battery contained within the laptop computer. Currently, these internal batteries have only a limited battery life before they need to be recharged by plugging the laptop into an electrical outlet. Thus, if the lecture or presentation lasts for an extended period of time, students operating laptop computers from battery power must either shut down their computer or plug their computer into an electrical outlet in the lecture hall to recharge the internal batteries.

It has been known to provide electrical outlets at spaced locations along the desktop for receiving the plug of a computer or other accessory. However, electrification systems of this type are typically mounted to the desktop separate from the seating. It is not generally known to provide power and data outlets on seating separate from the desktop, such as in auditorium or theater seating in which the work surface typically consists of a separate tablet arm mounted to each seat for movement between an operative, use position and an inoperative, storage position.

It is an object of the present invention to provide a stationarily-mounted seating structure that includes a plurality of individual seat assemblies that each includes both an electrical outlet and a data outlet for each of the seat occupants. It is a further object of the invention to provide a seating structure that conceals the electrical and data wires within the seating structure. It is a further object of the invention to provide an electrical wireway within each individual seat assembly that allows the seating structure to be easily configured to include a user-selected number of individual seat assemblies. A still further object of the invention is to provide a seating structure having a single, concealed electrification connection for supplying electrical power to the entire seating structure and a single, concealed connection to a main data terminal for the data lines contained within the seating structure. An additional object of the invention is to provide a seating structure including a movable support tablet on each of the seat assemblies that can support a laptop computer plugged into the electrical and data outlets.

In accordance with one aspect of the invention, a seating structure is constructed having a row of spaced individual seat assemblies. Each individual seat assembly includes an electrical outlet and at least one data outlet, which are preferably mounted to a structural side support of the seat assembly. Each of the individual seat assemblies includes a concealed wireway formed in the seat back, which extends between a pair of the spaced side supports. The wireway in each seat back is in communication with the wireways formed in the adjacent seat assemblies such that a main electrical conduit and a plurality of data lines can pass between the seat assemblies through the aligned electrical wireways. A branch electrical conduit extends from the electrical outlet available on each seat assembly through one of the side supports and joins the main electrical conduit contained in the wireway to provide electrical power to the electrical outlet. Likewise, one of the data lines extends through the side support and is joined to the data outlet. In the preferred embodiment of the invention, the electrical outlet and data outlet are each conveniently mounted to the right side support of each seat assembly.

In accordance with yet another aspect of the invention, each seat assembly preferably includes an oversized rotatable support tablet that is large enough to accommodate the size of a conventional laptop computer, such that the support tablet can support the laptop when the laptop is coupled to the data outlet and electrical outlet of the seat assembly. In another feature of the invention, only one seat assembly in the row of seat assemblies includes an infeed electrical conduit for supplying electrical power to the entire row of seat assemblies. Preferably, the infeed electrical conduit passes through only one of the side supports contained in the entire seating structure such that electrical power can be conveniently distributed throughout the seating structure. An infeed data input/output connection also passes through only one of the side supports of the seating structure, such that each data outlet in the entire row of seat assemblies can be coupled to a main data terminal through the infeed data connection.

In accordance with yet another aspect of the invention, each individual seating assembly includes an enclosed wireway that conceals and protects the electrical wiring and data lines within the seating structure. A power/data divider is mounted in each of the wireways to separate the electrical wiring from the data lines.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
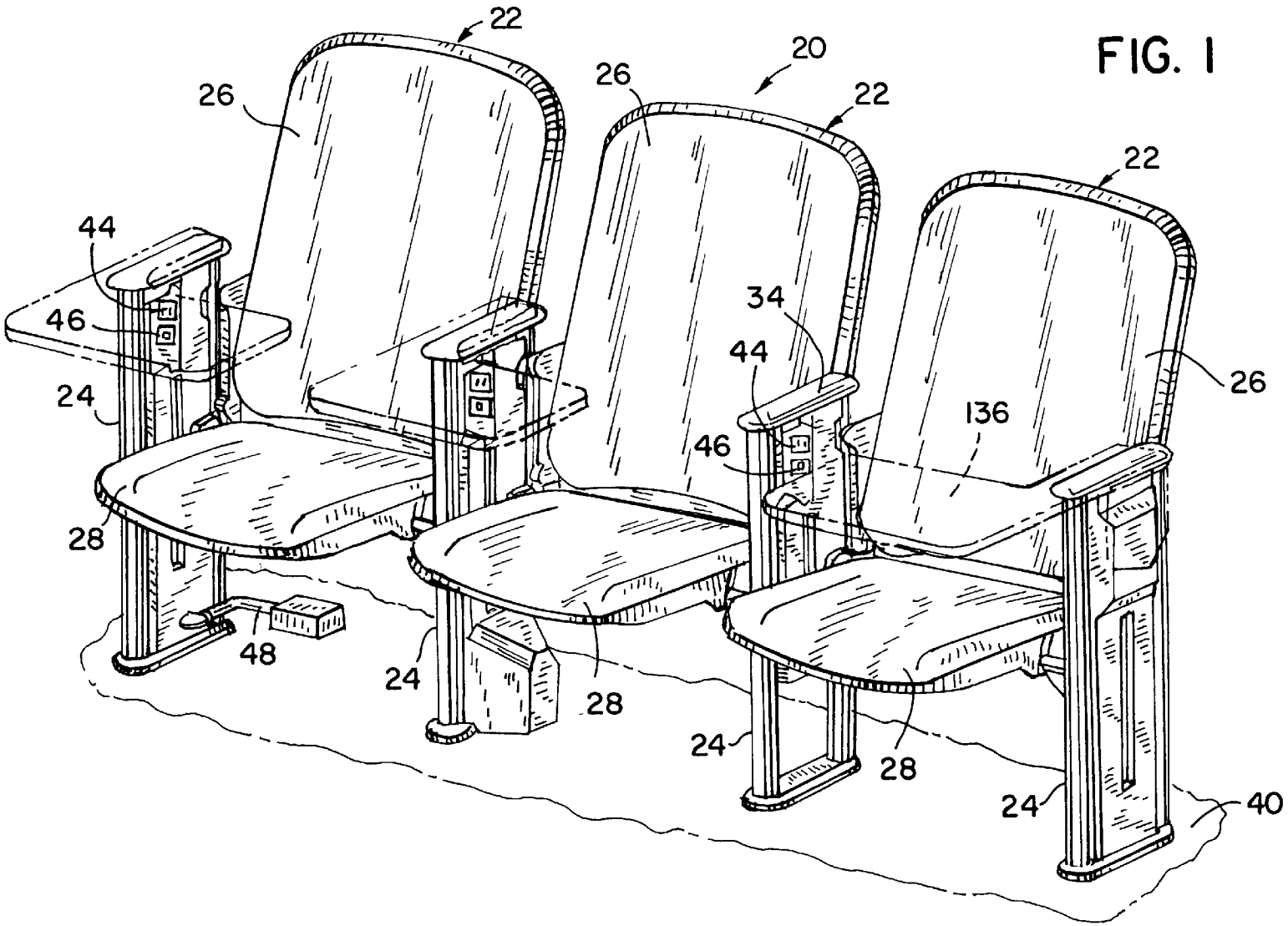
FIG. 1 is an isometric view of a stationarily-mounted seating structure of the present invention including a row of individual seat assemblies each having an electrical outlet and a data outlet.
Figure 2:
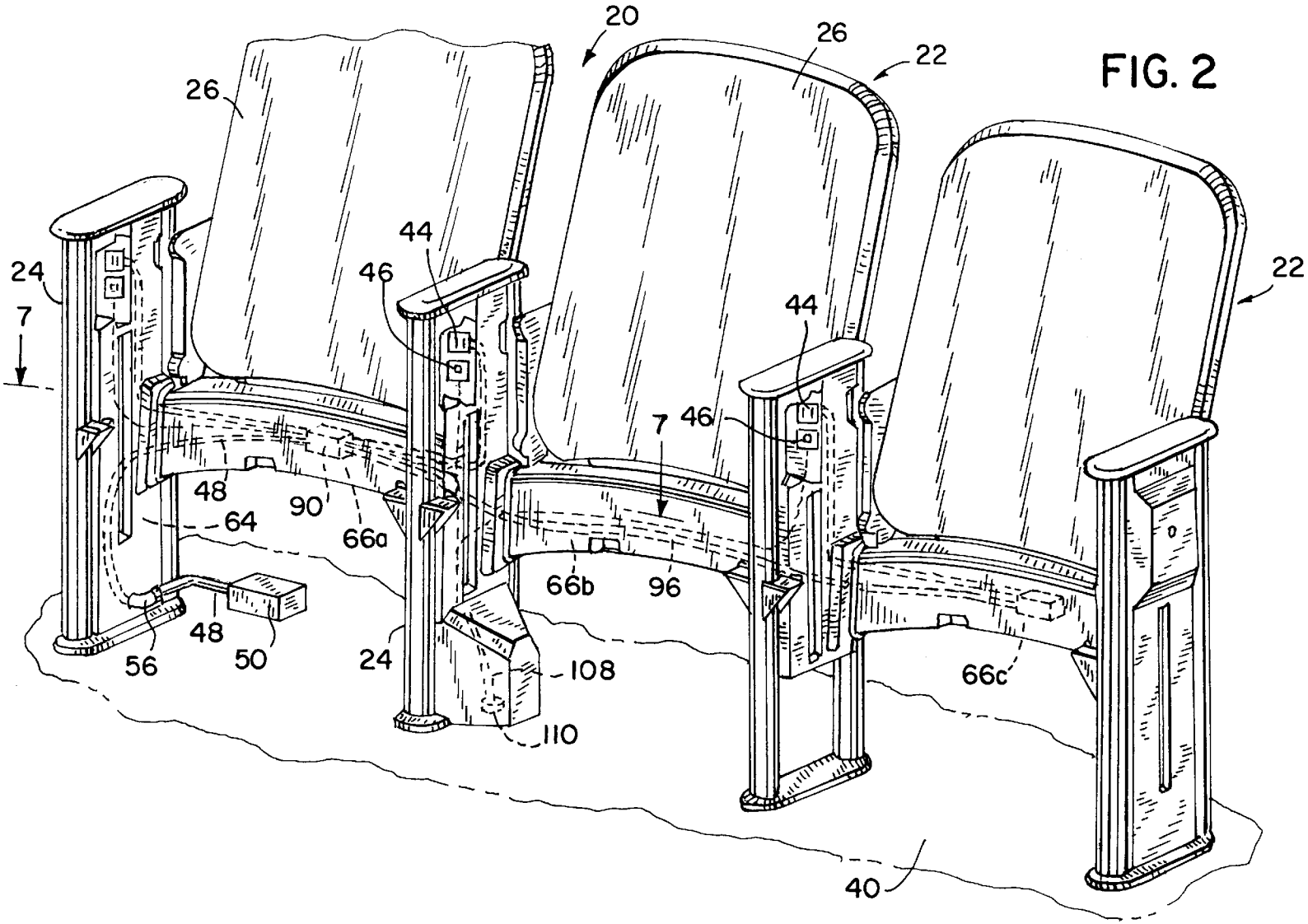
FIG. 2 is an enlarged, partial isometric view of the of the seating structure of the prevent invention illustrating the concealed electrical wiring and data lines in phantom.

FIGS. 1 and 2 illustrate a stationarily-mounted seating structure 20 that is particularly useful in creating rows of aligned seats for use in large halls, auditoriums, theaters or the like. Seating structure 20 includes a plurality of aligned individual seat assemblies 22 that form the row of seats. In the embodiment of the invention shown in FIG. 1, three individual seat assemblies 22 are shown aligned in a row, although it should be understood that a more typical seating structure 20 would include a larger number of aligned individual seat assemblies 22.

Each seat assembly 22 generally includes a pair of side supports 24, a seat back 26 fixedly joined between the side supports 24, and a seat 28 pivotably mounted between the side supports 24. In a manner that is well-known, each of the seat assemblies 22 are adapted for installation in rows, as shown, in which one or both of the side supports 24 are common to an adjacent seat assembly. The details of seat assembly 22, including the mounting arrangement between the pivotal seat 28 and the side supports 24, are shown and described in commonly assigned co-pending patent application Ser. No. 08/700,293 filed Aug. 20, 1996, incorporated herein by reference.

Figure 3:
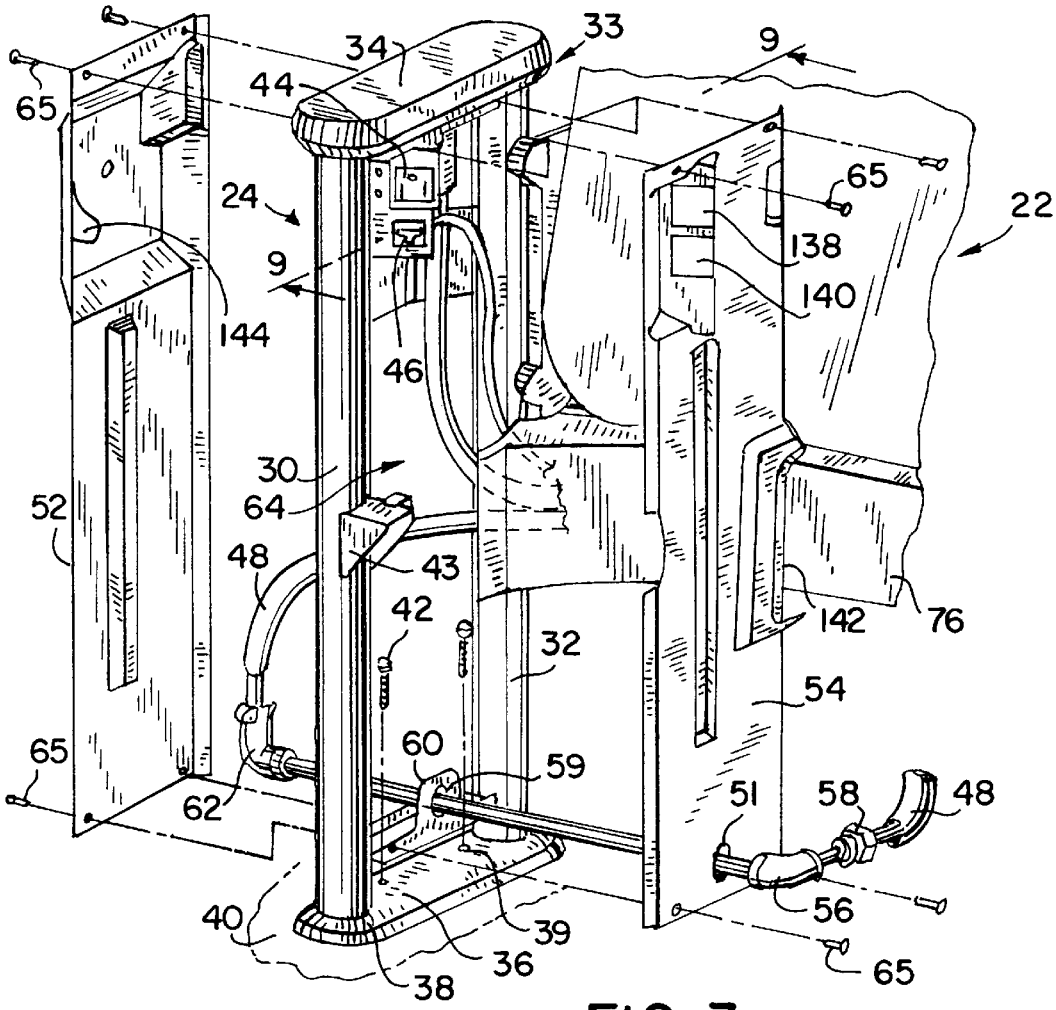
FIG. 3 is an enlarged, partially exploded isometric view of a side support of the seating structure, illustrating the electrical wiring and data lines contained within the side support.

Referring now to FIG. 3, each side support 24 contained in the seating structure 20 has a substantially identical construction and includes a forward vertical support member 30 defining an upper end and a lower end, and a rearward vertical support member 32 also defining an upper end and lower end. The support members 30, 32 may have any satisfactory shape and, as illustrated, are in the form of round tubular members. The support members 30,32 are welded at their upper ends to an armrest 33 including a top plate (not shown) and an attached armcap 34. The armcap 34 may be cushioned to provide cushioned support for the arms of a seat occupant when seated in the seat assembly 22. Support members 30,32 are welded at their lower ends to a bottom plate 36. Each bottom plate 36 includes a depending peripheral lip 38, the lower edge of which engages a floor 40 or other supporting surface. Openings 39 formed in the bottom plate 36 receive a pair of anchor bolts 42 or the like for securing the bottom plate 36, and thereby the entire side support 24, to the floor 40. A seat support bracket 43 is mounted to the forward support member 30 to support the seat 28 for pivoting movement between a downward, seating position as shown in FIG. 1, and an upright, storage position when seat assembly 22 is unoccupied.

As seen in FIGS. 1 and 2, each seat assembly 22 of the seating structure 20 includes an electrical outlet 44 and a data outlet 46 contained in one of each side support 24. The electrical outlet 44 provides the occupant of each seat assembly 22 with a supply of electrical power, while the data outlet 46 provides the seat occupant with a data port that provides access to a central computer system or other type of data device. As can best be seen by the phantom lines in FIG. 2, the electrical wiring and data lines for each of the electrical outlets 44 and data outlets 46 are concealed within the side supports 24 and the seat backs 26 of the row of aligned seat assemblies 22.

As best shown in FIGS. 2 and 3, the entire seating structure 20 is electrified by a single connection to a supply of electrical power through an infeed electrical conduit 48. The infeed electrical conduit 48 is connected to the electrical power system for the building by a junction box 50 contained on the floor 40 of the auditorium or lecture hall. The supply of electrical power preferably comes up through the floor 40 and is connected to the infeed electrical conduit 48 within the junction box 50. In one embodiment of the invention, the power infeed conduit 48 may consist of four 12-gauge wires and one 10-gauge neutral wire encased in a liquid-tight conduit that are hard wired in the junction box 50 to the building power supply.

Referring now to FIG. 3, the infeed electrical conduit 48 enters into the side support 24 through an access opening 51 formed in one of a pair of side cover members 52, 54. An elbow 56 and a liquid-tight connector 58 provide the required protection and insulation for the infeed electrical conduit 48 as it enters the side support 24. The infeed electrical conduit 48 then passes through an opening 59 formed in a bottom side cover bracket 60 mounted to the bottom plate 36 of the side support 24 by the anchor bolts 42. A second elbow 62 is mounted to the bottom side cover bracket 60 and directs the infeed electrical conduit 48 upward into an open interior 64 (FIG. 7), which is defined by the pair of side covers 52, 54 that are mounted between the support members 30,32 by conventional connectors 65 (FIG. 3). Each of the side covers 52, 54 give the side support 24 a smooth, attractive appearance while concealing and protecting the electrical wiring and data lines contained within the open interior 64.

As can best be seen in FIGS. 1 and 2, the infeed electrical conduit 48 passes through one of the endmost side supports 24 in the seating structure 20 to provide electrical power for the entire seating structure 20. In an auditorium or lecture hall having multiple rows of seats each defined by one of the seating structures 20, each row would include only a single infeed electrical conduit 48 to provide electrical power for the entire seating structure 20. Although the infeed electrical conduit 48 is shown as being connected to the leftmost side support 24, it should be understood that the infeed electrical conduit 48 could pass through any of the side supports 24. In any case, the infeed electrical conduit 48 only passes through one of the plurality of side supports 24 to electrify the entire seating structure 20.

Figure 5:
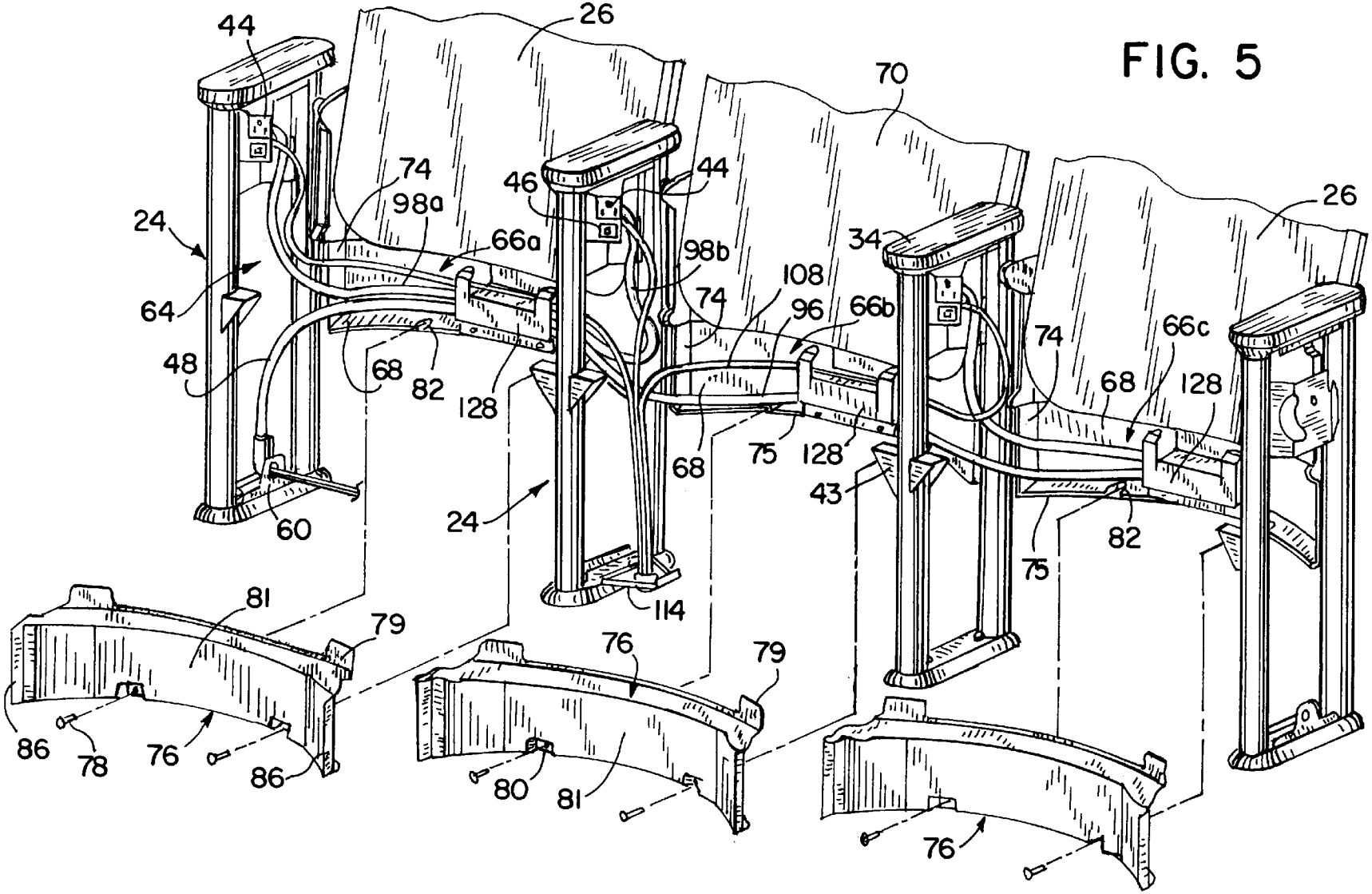
FIG. 5 is an enlarged, partially exploded isometric view illustrating wireways formed in the seat backs of each seat assembly of the seating structure.
Figure 6:
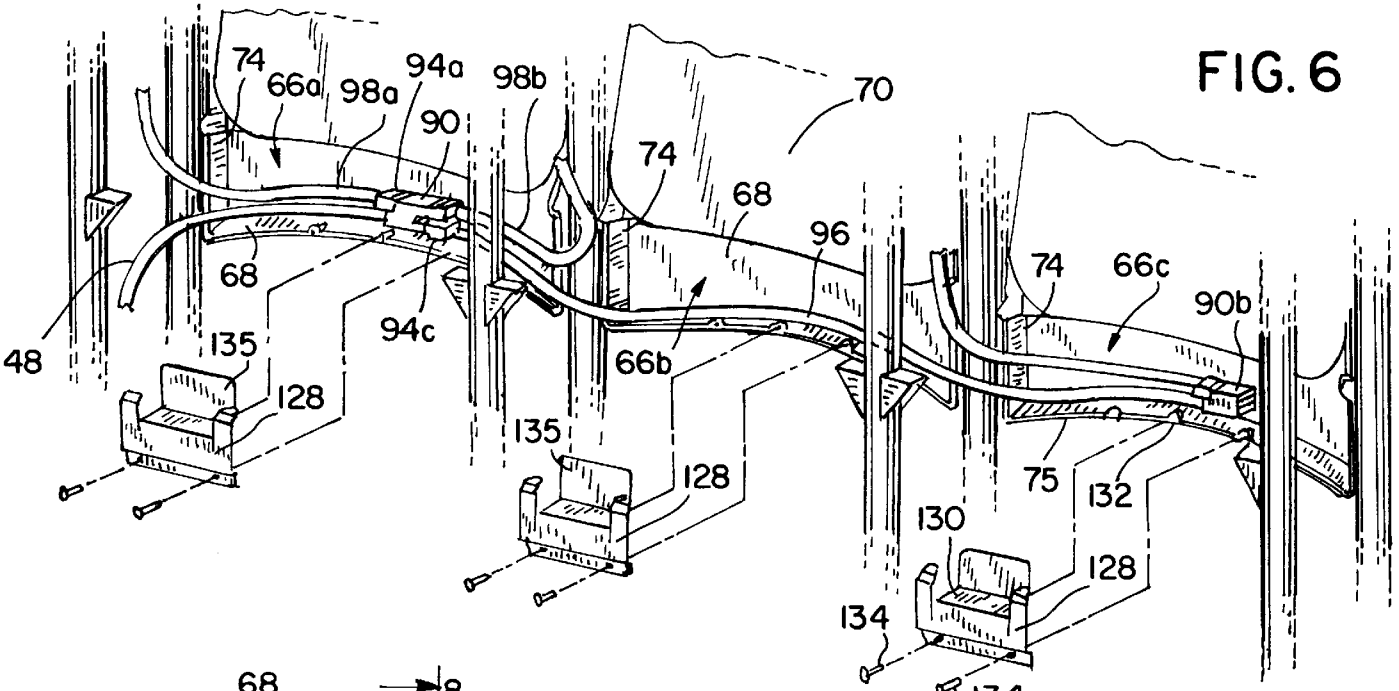
FIG. 6 is an enlarged, partially exploded isometric view illustrating the positioning of a power/data divider within the wireway formed in each of the seat backs.
Figure 7:
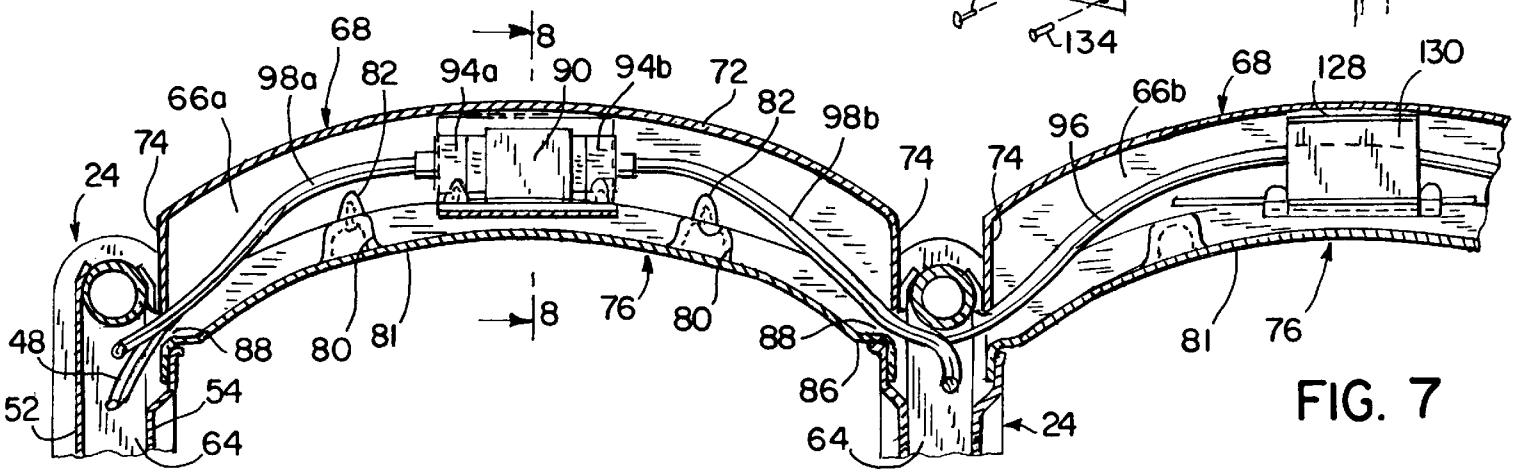
FIG. 7 is a partial section view taken along line 7—7 of FIG. 2 illustrating the wireway formed in the seat back of each of the seat assemblies.

The infeed electrical conduit 48 passes from the open interior 64 of the side support 24 into a wireway 66*a* formed in the endmost seat back 26, as shown in FIGS. 5–7, and similar wireways 66*b*, 66*c* are formed in the adjacent seat backs 26. The wireway 66*a* defines a generally open space that allows both the electrical wires and data lines to pass between the adjacent seat assemblies 22. The wireways 66*a–c* formed in each seat back 26 are each generally defined by a molded back panel 68 positioned below a back cushion 70 contained on the seat back 26. The back panel 68 can be either molded directly into the seat back 26 or attached as a separate structure. The back panel 68 includes and arcuate back wall 72, a pair of forwardly extending side walls 74 and a bottom wall 75. The side walls 74 and bottom wall 75 generally extend from the arcuate back wall 72 to define the depth of each wireway 66*a–c*. The wireways 66*a–c* are sufficiently deep to permit the required electrical connections for the seating structure 20 as will be discussed in detail below.

Each wireway 66*a–c* is completely enclosed by a wireway cover 76 that is secured to the back panel 68 by a pair of screws 78 and a pair of locking tabs 79, as shown in FIG. 5. Specifically, the locking tabs 79 are inserted behind the back cushion 70 and each of the screws 78 passes through mounting tabs 80 recessed from front face 81 of the wireway cover 76. The screws 78 are each received in a molded boss 82 formed in the bottom wall 75 of the back panel 68, as shown in FIGS. 5 and 7.

Each wireway cover 76 includes a flange 86 formed on each of its outer ends that extends forwardly from the front face 81. When the wireway cover 76 is mounted to the back panel 68, the flanges 86 each engage a lip located at the rearward edge of each side cover 52 or 54 and are located forwardly of each back panel side wall 74, to create an opening 88 (FIG. 7) between the respective wireway 66*a–c* and the open interior 64 of the adjacent side support 24. The openings 88 permit the electrical wiring and data lines to pass between the adjacent seat assemblies 22, as shown best in FIG. 7. The top and bottom walls of each wireway cover 76 are configured to cooperate with back panel 68 to enclose the top and bottom, respectively, of each opening 88.

As shown in FIG. 2, the infeed electrical conduit 48 extends upward through the open interior 64 of the side support 24 and into the wireway 66*a* formed in the endmost seat back 26. The infeed electrical conduit 48 terminates at a 3-way connection plug 90. As can best be seen in FIG. 10, the 3-way connection plug 90 includes three receptacles 92*a–c* that each can receive an end plug 94*a–c* from additional electrical conduits, as will be described below. In the preferred embodiment of the invention, the infeed electrical conduit 48 including the 3-way connection plug 90 is a commercially available product from Pent, Inc. of Kendallville, Indiana under its model no. 180016 and is commonly referred to as a UHI conduit. Additionally, each of the end plugs 94*a–c* is preferably a simplex end plug that provides a conventional connection to the five wires in the infeed electrical conduit 48.

Figure 10:
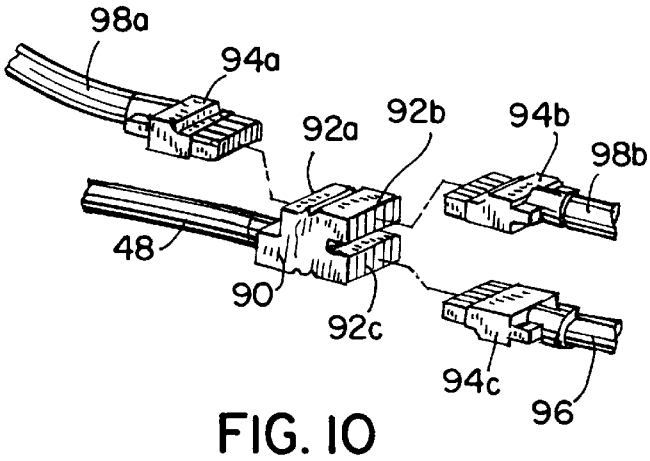
FIG. 10 is an enlarged exploded isometric view illustrating the electrical wire connections within the seat assembly.

As shown in FIGS. 6 and 10, one of the end plugs 94*c* is contained on a main electrical conduit 96 that extends from the wireway 66*a* containing the 3-way connection plug 90 through the wireway 66*b* of the adjacent seat assembly 22 and into the wireway 66*c* of the next adjacent seat assembly 22. The main electrical conduit 96 terminates at a 3-way connection plug 90*b*. While the drawings illustrate only three individual seat assemblies 22, it should be understood that additional main electrical conduits 96 are coupled together using connection plugs 90*b* such that the electrical wiring extends through a row of seat assemblies 22 including additional individual seat assemblies 22 similarly aligned in a continuous row.

Referring now to FIGS. 5 and 6, a pair of branch electrical conduits 98*a* and 98*b* are connected to the 3-way connection plug 90 by corresponding end plugs 94*a* and 94*b*. Each of the branch electrical conduits 98*a*, 98*b* extends from the 3-way connection plug 90 to one of the electrical outlets 44 contained in the side supports 24 positioned adjacent to the seat back 26 in which the 3-way connection plug 90 is housed. Specifically, the branch electrical conduit 98*a* extends into the endmost side support 24, while the second branch electrical conduit 98*b* is connected to the electrical outlet 44 contained in the second side support 24 from the end. In this manner, a single 3-way connection plug 90 contained in the wireway 66 of every other seat assembly 22 provides electric power to the electrical outlets 44 for two adjacent seat assemblies 22, while also providing a connection for the main electrical conduit 96 that supplies electrical power to the remaining seat assemblies 22 of the seating structure 20.

Figure 9:
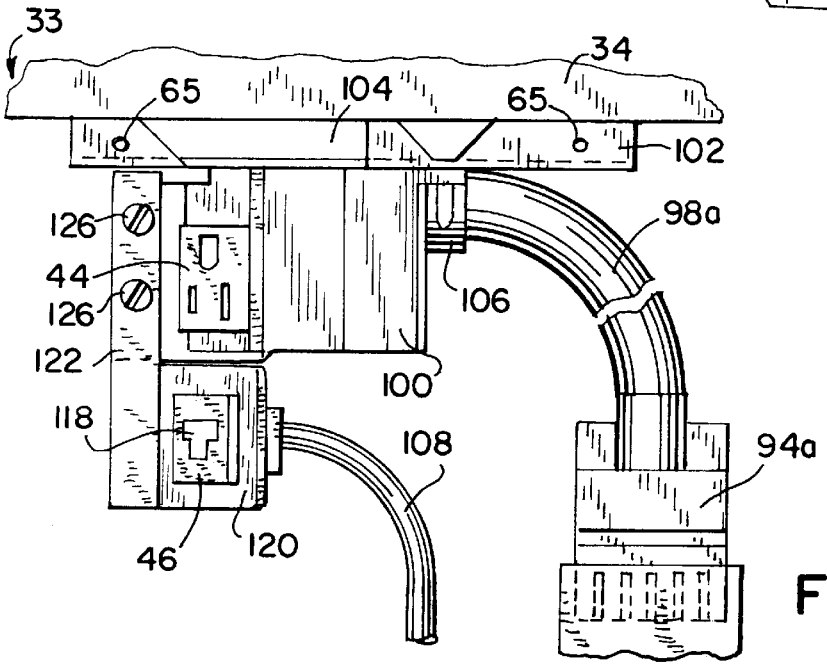
FIG. 9 is an enlarged partial side elevation view taken along line 9—9 of FIG. 3 illustrating the mounting of the electrical and data outlets.

FIG. 9 illustrates the mounting and electrical connection for the electrical outlet 44 contained in each side support 24. The electrical outlet 44 is contained within a receptacle box 100 that includes a mounting plate 102. The receptacle box 100 hangs below the armrest 33 and is supported by the mounting plate 102 that is joined to a top plate 104 by connectors (not shown) which extend vertically upwardly through mounting plate 102 into openings formed in the underside of armrest 33. The receptacle box 100 is angled relative to the longitudinal axis of the armrest 33, such that the electrical outlet 44 extends at a slight angle toward the seat occupant to allow easy plug-in and removal of plugs. The receptacle box 100 includes a support cradle 106 that receives and supports the branch electrical conduit 98*a*, which extends downwardly from the receptacle box 100 and into the wireway 66*a*, where the end plug 94*a* joins the branch electrical conduit 98*a* to the 3-way connection plug 90.

Figure 4:
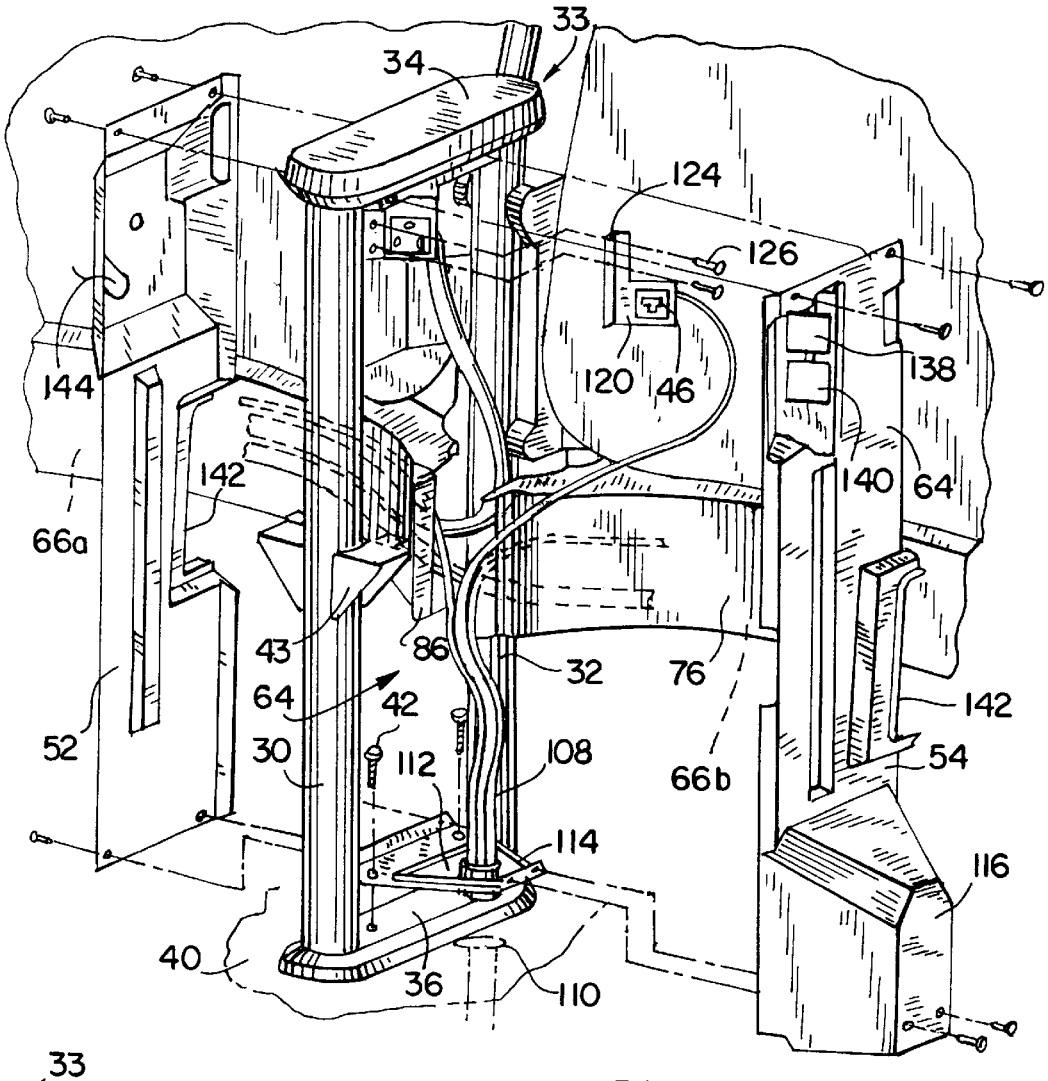
FIG. 4 is an enlarged, partially exploded isometric view illustrating the origination of the data lines and the mounting of the data outlet to one of the side supports.

In addition to the electrical outlet 44 contained in one of the side supports 24 for each seat assembly 22, the preferred embodiment of the seating structure 20 includes at least one data outlet 46 for each of the seat assemblies 22. As shown in the Figures, the data outlet 46 for each seat assembly 22 is generally positioned below the electrical outlet 44. Referring now to FIG. 4, a bundle of data lines 108 pass through a data infeed opening 110 formed in the floor 40. Each of the data lines 108 is connected to a central computer system (not shown) or similar structure for the building in which the seating structure 20 is installed. For example, if the seating structure 20 is installed in a university lecture hall, each of the data lines 108 may be connected to the university computer system or a main computer being operated by a professor presenting the class.

The bundle of data lines 108 pass through an access opening 112 formed in a data line bracket 114 that is connected to the bottom plate 36 of the side support 24. Since each individual seat assembly 22 requires a separate data line 108, the bundle of data lines 108 includes as many data lines 108 as the number of seat assemblies 22 aligned in the row. In the embodiment of the invention shown in the Figures, the bundle of data lines 108 includes only three individual data lines 108, since the row of seats only includes three individual seat assemblies 22.

Data lines 108 pass through the generally open interior 64 formed in the side support 24 and are fed into the wireways 66*a*–c formed in each of the seat backs 26. The required number of data lines 108 are fed in each direction from the data infeed opening 110 based on the number of seat assemblies 22 in each direction. In the embodiment of the invention shown in the FIG. 4, a single data line 108 is fed to the left of the side support 24 and into the wireway 66*a*, while a second data line 108 is fed to the right of the side support 24 and into the wireways 66*b* and 66*c*. The final data line 108 passes upward through the side support 24 and is joined to the data outlet 46 for that side support 24.

As can best be understood in FIG. 2, only one data infeed opening 110 is formed in the floor 40 for each seating structure 20. In an auditorium or lecture hall having multiple rows of seats each defined by one of the seating structures 20, each row would include only the single data infeed opening 110. In this manner, all of the data lines 108 for the entire row of seat assemblies 22 pass through the single side support 24. In the embodiment of the invention shown in FIG. 2, the bundle of data lines 108 enter through the second side support 24 from the end of the row and are distributed through the wireways 66*a*–c formed in the seat backs 26, as shown in FIG. 4. It should be understood, however, that the infeed for data lines 108 may be at any location along the length of seating structure 20.

An expanded data infeed housing 116 is formed in the side cover 54 attached to the side support 24, as shown in FIG. 4. The data infeed housing 116 interacts with the data line bracket 114 and protects the bundle of data lines 108 from contact by the seat occupant.

Referring now to FIGS. 4 and 9, each data outlet 46 includes a conventional data jack 118, such that the data outlet 46 can be coupled to a laptop computer by conventional wires, such as a telephone cord. Although the data jack 118 shown in FIG. 9 accepts a conventional telephone adapter plug, the data jack 118 could also be configured to accept an Ethernet adapter or other equivalent structure. The data outlet 46 is supported by a data plate 120 that in turn is connected to a mounting plate 122. The mounting plate 122 includes a pair of mounting holes 124 that each receives a connector 126. The connectors 126 are received within corresponding holes formed in the receptacle box 100 such that the data outlet 46 can be supported below the receptacle box 100. The mounting plate 122 is angled relative to the data plate 120 such that the orientation of the data outlet 46 corresponds to the orientation of the electrical outlet 44. Although only one data outlet 46 is shown, it is contemplated that multiple data outlets 46 could be included in each of the side supports 24.

As shown in FIGS. 5–7, a power/data divider 128 is mounted within each of the wireways 66*a*–*c* formed in the seat backs 26. The dividers 128 are mounted within the wireways 66*a*–*c* to separate the data lines 108 from the electrical wires passing through the wireways 66*a*–*c*. Since electronic data messages passing through the data lines 108 can be adversely affected by power surges within the electrical wires when the electrical wires and data lines are in close proximity, the dividers 128 provide physical separation between the data lines and the electrical wires to prevent any such adverse effects.

Figure 8:
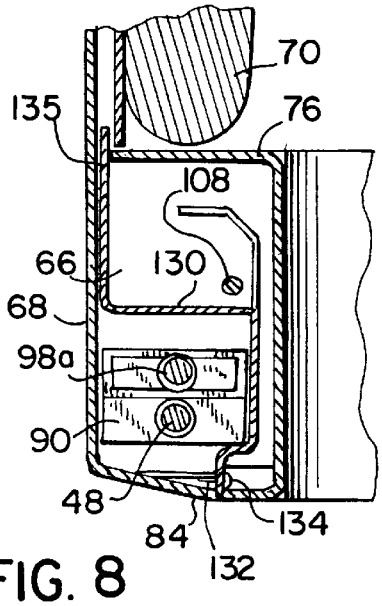
FIG. 8 is a partial section view taken along line 8—8 of FIG. 7 illustrating the power/data divider positioned within the wireway.

Referring now to FIGS. 6 and 8, the divider 128 includes a generally horizontal shelf 130 that physically separates the data lines 108 from the electrical wiring, such as the infeed electrical conduit 48 and the branch electrical conduit 98*a*. As shown in FIG. 6, each divider 128 is attached to a pair of bosses 132 formed in the bottom wall 75 of the seat back 26 by a pair of connectors 134. A top flange 135 extends upwardly from the rear edge of shelf 130 behind the seat cushion 70 to support the upper end of the divider 128, as can be seen in FIG. 8.

Referring now to FIG. 1, in a preferred embodiment of the invention a support tablet 136 is pivotably mounted to one of the side supports 24 for each of the seat assemblies 22. The support tablets 136 are shown in phantom in FIG. 1 in a raised, operative position. In this position, the support tablet 136 can support a laptop computer or other type of electronic device that can then be connected to the electrical outlet 44 and/or the data outlet 46. Preferably, the support tablet 136 is sized large enough such that it provides adequate surface area to support a standard laptop or notebook computer. A conventional mounting arrangement is used to pivotably mount the support tablet 136 to one of the side supports 24, as is well known in the prior art, such that support tablet 136 is movable between the raised, operative position and a lowered, storage position.

Referring now to FIG. 3, the side cover 54 includes a pair of molded outlet openings 138 and 140 that provided access to both the electrical outlet 44 and the data outlet 46 when the side cover 54 is mounted to the support members 30,32 of the side support 24. Additionally, the side cover 54 includes a removed, molded channel 142 that is sized to receive the wireway cover 76 when the side cover 54 is mounted to the side support 24, as is shown in FIG. 2. In this manner, the side cover 54 provides a smooth transition between the seat back 26 and the arm rest assembly 24 while protecting the data lines 108 and electrical wiring. The opposite side cover 52 includes a corresponding molded channel 142 that also receives the wireway cover 76 and further includes a curved opening 144 (FIG. 4) that allows the rotatable support tablet 136 to be mounted to the side support 24. In the preferred embodiment of the invention, both of the side covers 52 and 54 are vacuum formed from a plastic material that provides an aesthetically pleasing outer appearance for the side support 24 of each seat assembly 22.

Various alternatives and embodiments are contemplated as being within the scope of the following claims particularly pointing out and distinctly claiming the subject matter regarded as the invention.

I claim:

1. A seating system having a plurality of individual seat assemblies aligned in a row, each seat assembly having a pair of side supports, a seat supported between the side supports, and a seat back supported between the side supports, the seating system comprising;

an electrified electrical outlet mounted to one of the side supports for each seat assembly, the electrified electrical outlet configured to receive an electric plug from an external device to provide electrical power to the external device; and at least one data outlet mounted to one of the side supports for each seat assembly, the data outlet being coupled to a main data terminal and configured to receive a data plug from an external device to permit the external device to communicate with the main data terminal.

2. The seating system of claim 1 wherein the electrical outlet and the data outlet are each mounted to the same side support for each seat assembly.

3. The seating system of claim 1 further comprising a main electrical conduit extending between each seat assembly, wherein each electrical outlet is coupled to the main electrical conduit.

4. A seating system having a plurality of individual seat assemblies aligned in a row, each seat assembly having a pair of side supports, a seat supported between the side supports, and a seat back supported between the side supports, the seating system comprising;

an electrical outlet mounted to one of the side supports for each seat assembly;

a wireway formed in the seat back of each seat assembly, wherein each wireway is in communication with the wireway formed in the seat backs of the adjacent seat assemblies in the seating system; and an electrified main electrical conduit extending through the wireways contained in the seat backs of the row of aligned seat assemblies, wherein each electrical outlet is coupled to the main electrical conduit to provide electrical power to the electrical outlet.

5. The seating system of claim 4 further comprising an infeed electrical conduit connected between the main electrical conduit and a supply of electricity to electrify the main electrical conduit, the infeed electrical conduit contained within only one side support in the row of seat assemblies.

6. The seating system of claim 5 further comprising a branch electrical conduit extending between each electrical outlet and the main electrical conduit, each branch electrical conduit concealed within the wireway of the seat assembly and an open interior formed in the side support containing the electrical outlet.

7. The seating system of claim 6 wherein the main electrical conduit is formed from a plurality of individual conduit segments, each conduit segment having an end block that receives a pair of the branch electrical conduits.

8. The seating system of claim 4 wherein the wireway in each seat back is formed by a back panel formed in the seat back and a detachable wireway cover.

9. The seating system of claim 4 further comprising at least one data outlet mounted to one of the side supports for each seat assembly.

10. The seating system of claim 9 further comprising a plurality of data lines extending through the wireways formed in the seat backs, each data line having a first end connected to one of the data outlets.

11. The seating system of claim 10 wherein each of the plurality of data lines includes a second end connected to a main data terminal, each of the plurality of data lines passing through only one side support of the row of seat assemblies.

12. The seating system of claim 10 further comprising a divider contained in the wireway of each seat assembly, the divider positioned to separate the main electrical conduit from the plurality of data lines.

13. The seating system of claim 10 further comprising a tablet rotatably connected to one of the side supports for each seat assembly.

14. A seating system having a plurality of individual seat assemblies aligned in a row, each seat assembly having a pair of side supports, a seat supported between the side supports, and a seat back supported between the side supports, the seating system comprising:

an electrical outlet mounted to one of the side supports for each seat assembly;

at least one data outlet mounted to the side support containing the electrical outlet for each seat assembly;

a wireway formed in the seat back of each seat assembly, wherein each wireway is aligned with and in communication with the wireway formed in the seat back of the adjacent seat assemblies in the seating structure;

an electrified main electrical conduit extending through the aligned wireways contained in the seat backs of the row of aligned seat assemblies, wherein each electrical outlet is coupled to the main electrical conduit; and a plurality of data lines extending through the aligned wireways contained in the seat backs of the row of aligned seat assemblies, each data line coupled to one of the data outlets.

15. The seating system of claim 14 further comprising a divider contained in the wireway of each seat assembly, the divider positioned to separate the main electrical conduit from the plurality of data lines.

16. The seating system of claim 14 further comprising an infeed electrical conduit connected between the main electrical conduit and a supply of electricity to electrify the main electrical conduit, the infeed electrical conduit contained within a single side support in the row of seat assemblies.

17. The seating system of claim 16 further comprising a branch electrical conduit extending between each electrical outlet and the main electrical conduit, the branch electrical conduit concealed within the wireway and an open interior formed in the side support containing the electrical outlet.

18. The seating system of claim 17 wherein the main electrical conduit is formed from a plurality of individual conduit segments, each conduit segment having an end block that receives a pair of the branch electrical conduits.

19. The seating system of claim 14 wherein the wireway in each seat back is formed by a back panel formed in the seat back and a detachable wireway cover.

20. The seating system of claim 14 wherein the plurality of data lines are each connected to a main data terminal by passing through a single side support of the row of seat assemblies.

21. The seating system of claim 14 wherein each side support includes an arm rest positioned to support the arm of a seat occupant, wherein both the electrical outlet and data outlet are supported from the arm rest.

22. A seat assembly, comprising;

a pair of spaced side supports;

a seat rotatably mounted between the pair of spaced side supports;

a seat back mounted between the pair of side supports; an electrical outlet contained in one of the side supports, the electrical outlet being coupled to a supply of electrical power and configured to receive an electric plug of an external device to provide electrical power to the external device; and a data outlet contained in one of the side supports, the data outlet being coupled to a main data terminal and configured to receive an external data plug of an external device to permit the external device to communicate with the main data terminal.

23. The seat assembly of claim 22 further comprising a support tablet rotatably connected to one of the side supports.

24. The seat assembly of claim 22 wherein the electrical outlet and the data outlet are each contained in the same side support.

25. A seat assembly, comprising;

a pair of spaced side supports;

a seat rotatably mounted between the pair of spaced side supports;

a seat back mounted between the pair of side supports;

a wireway formed in the seat back, wherein when a plurality of seat assemblies are aligned in a row, the wireway of each seat assembly communicates with the wireway of the adjacent seat assemblies;

an electrical outlet contained in one of the side supports the electrical outlet being coupled to a supply of electrical power and configured to receive an electric plug of an external device to provide electrical power to the external device; and a data outlet contained in one of the side supports, the data outlet being coupled to a main data terminal and configured to receive an external data plug of an external device to permit the external device to communicate with the main data terminal .

26. The seat assembly of claim 25 wherein the wireway is formed by a back panel formed in the seat back and a detachable wireway cover.

27. A seating system having a plurality of individual seat assemblies aligned in a row, each seat assembly having a pair of side supports, a seat supported between the side supports, and a seat back supported between the side supports, the seating system comprising:

an electrical outlet mounted to the side supports for each seat assembly;

an enclosed wireway extending along the row of individual seat assemblies; and an electrified main electrical conduit extending through the wireway, wherein each electrical outlet is coupled to the main electrical conduit to provide electrical power to the electrical outlet and configured to receive an electric plug of an external device to provide electrical power to the external device.

28. The seating system of claim 27 further comprising:

at least one data outlet mounted to one of the side supports for each seat assembly; and a plurality of data lines extending through the wireway, each data line being coupled to one of the data outlets.

29. The seating system of claim 27 wherein the wireway is positioned beneath the seat backs of the row of seat assemblies.

* * * * *